US008862010B2

(12) United States Patent
Ando

(10) Patent No.: US 8,862,010 B2
(45) Date of Patent: Oct. 14, 2014

(54) IMAGE FORMING APPARATUS

(75) Inventor: Yohei Ando, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 204 days.

(21) Appl. No.: 13/484,974

(22) Filed: May 31, 2012

(65) Prior Publication Data

US 2013/0022366 A1 Jan. 24, 2013

(30) Foreign Application Priority Data

Jul. 20, 2011 (JP) ..... 2011-159292

(51) Int. Cl.
*G03G 15/20* (2006.01)

(52) U.S. Cl.
CPC ..... *G03G 15/205* (2013.01); *G03G 2215/2025* (2013.01)
USPC ..... 399/70

(58) Field of Classification Search
CPC ..... G03G 15/205; G03G 15/2039
USPC ..... 399/69, 70
See application file for complete search history.

(56) References Cited

U.S. PATENT DOCUMENTS 7,277,650 B2 * 10/2007 Ihara et al. ..... 399/67
7,683,297 B2 * 3/2010 Kishi et al. ..... 219/619

FOREIGN PATENT DOCUMENTS

JP 2005156769 A 6/2005
JP 2007108359 A 4/2007

* cited by examiner

*Primary Examiner* — Gregory H Curran
(74) *Attorney, Agent, or Firm* — Harness, Dickey & Pierce, P.L.C.

(57) ABSTRACT

A fixing device to perform a fixing process includes an endless, rotatable belt member; a nip-forming rotary member disposed outside a loop of the belt member; a fixing roller disposed at a backside of the fixing nip inside the loop of the belt member and around which the belt member is rotatably stretched; a heater to heat the belt member at a position different from a position where the belt member is rotatably stretched around the fixing roller; a temperature detector; a memory device to store an operational history of the heater; and a processor operatively connected to the heater to control the heater, before the recording sheet is passed through the fixing nip, to perform a warming-up operation to raise a temperature of the fixing roller at the backside of the fixing nip based on the operational history of the heater stored in the memory device.

9 Claims, 8 Drawing Sheets

IMAGE FORMING APPARATUS

CROSS-REFERENCE TO RELATED APPLICATIONS

The present application claims priority from Japanese patent application number 2011-159292, filed on Jul. 20, 2011, the entire contents of which are incorporated by reference herein.

BACKGROUND OF THE INVENTION

1. Field of the Invention

The present invention relates to a fixing device and an image forming apparatus including the fixing device.

2. Description of the Related Art

Image forming apparatuses typically employ a fixing device configured to perform a fixing process, in which a toner image carried on a recording sheet such as a sheet of paper is fused and fixed onto the sheet.

For example, JP-2005-156769-A discloses a belt-type fixing device including an endless rotary fixing belt looped around a plurality of rollers, opposed by a pressure roller to form a nip for fixation by contacting an outside of the fixing belt. Inside the fixing belt, there are at least a fixing roller and a heating roller. The fixing roller contacts the internal surface of the fixing belt and rotates while sandwiching the fixing belt together with the pressure roller that contacts the external surface of the fixing belt. The heating roller rotates while heating the fixing belt.

Normally, the fixing device includes a temperature detector such as a thermistor to detect a temperature of the surface of the fixing belt. The fixing device is controlled so that the fixing belt is rotated as the temperature detector detects the surface temperature of the fixing belt. The recording sheet is conveyed to the fixing nip upon the detected fixing belt surface temperature reaching a predetermined temperature.

In the type of the fixing device used in high-speed image forming apparatuses for bulk printing, a fixing nip having a length of 15 to 25 mm needs to be formed to secure a longer fixing time. For that purpose, a fixing roller with a larger diameter is used to form a greater nip, and a bite amount of the fixing roller into the opposed pressure roller needs to be greater. However, a distortion of the rubber layer of the fixing roller needs to be minimized even when the bite amount of the fixing roller into the pressure roller is increases. Accordingly, the fixing device for high-speed image forming apparatuses requires a fixing roller including a rubber layer with a greater depth.

As a result of greater depth of the rubber layer of the fixing roller, however, thermal capacity of the fixing roller increases and the fixing roller may be cooler than the surface of the fixing belt even through the fixing belt itself is sufficiently heated. When the temperature of the fixing roller does not reach a predetermined target temperature, the heat of the fixing belt is lost via not only the recording sheet but also the fixing roller at the fixing nip. Further, because the thermal expansion amount of the fixing roller is low, the nip pressure is decreased and the nip length shortened. As a result, the toner image on the recording sheet is not subjected to the necessary heat and pressure, resulting in defective imaging.

BRIEF SUMMARY OF THE INVENTION

The present invention provides an optimal fixing device and an image forming apparatus including the fixing device capable of reducing defective fixation.

The fixing device includes an endless, rotatable belt member; a heating roller disposed at a backside of the fixing nip inside a loop of the belt member and around which the belt member is rotatably stretched; a nip-forming rotary member disposed opposite the heating roller and outside the loop of the belt member, contacting the external surface of the belt member to form a fixing nip; a temperature detector disposed opposite the heating roller via the belt member; a heater to heat the belt member, disposed opposite the heating roller and inside the loop of the belt; a memory device to store an operational history of the heater; and a processor operatively connected to the heater to control the heater, before the recording sheet is passed through the fixing nip, to perform a warming-up operation to raise a temperature of the heating roller at the backside of the fixing nip based on the operational history of the heater stored in the memory device.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

A preferred embodiment of a color laser printer (hereinafter, simply "printer") 100 as an image forming apparatus including a fixing device 4 will now be described. The printer 100 includes a belt driving device as illustrated in FIG. 1.

Figure 1:
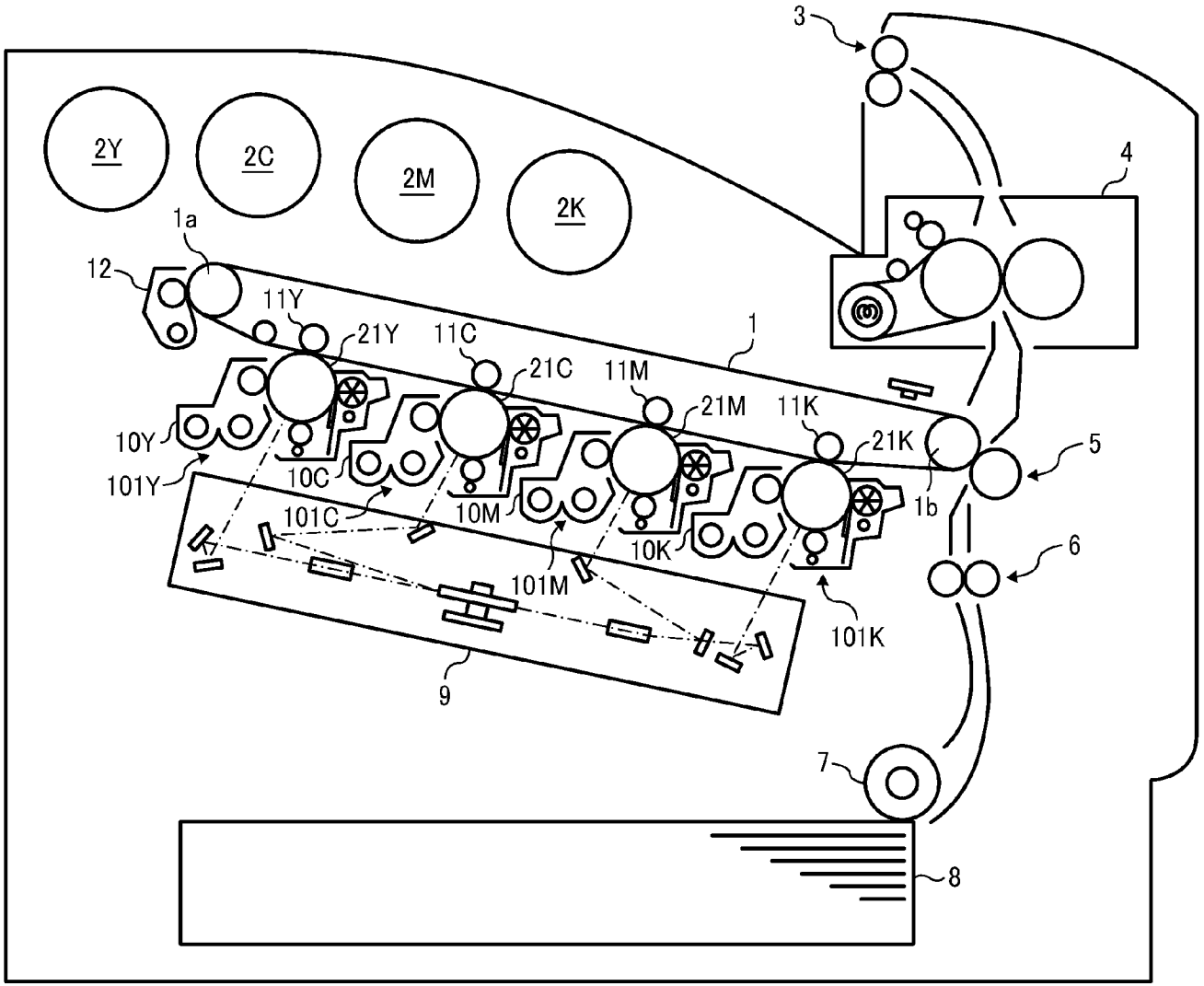
FIG. 1 is a schematic view of a image forming apparatus according to an embodiment of the present invention.

FIG. 1 shows a schematic configuration of the printer 100 according to the present embodiment.

The printer 100 includes a tandem image forming section in which four toner image forming units 101Y, 101C, 101M, and 101K each configured to form an image of a corresponding color of yellow, cyan, magenta, and black are laterally disposed in this order of colors from left to right. (Herein, each suffix of Y, C, M, and K represents yellow, cyan, magenta, and black, respectively.) In the tandem image forming section, each toner-image forming unit 101Y, 101C, 101M, or 101K includes a drum-shaped photoreceptor 21Y, 21C, 21M, and 21K. Around each photoreceptor, each toner-image forming unit 101Y, 101C, 101M, or 101K further includes a charger, a developer 10Y, 10C, 10M, or 10K, and a photoreceptor cleaner. Toner bottles 2Y, 2C, 2M, and 2K each containing toner one of yellow, cyan, magenta, and black toner are disposed at an upper part in the printer 100. Toner of each color is supplied to a corresponding developer 10Y, 10C, 10M, or 10K in predetermined amounts via a conveyance mechanism, not shown.

An optical writing unit 9, which is a latent image forming unit, is disposed at a lower part of the tandem image forming section. This optical writing unit 9 includes a light source, a polygonal minor, an fθ lens, a reflection mirror, and the like, and is configured to radiate laser beams while scanning each surface of the photoreceptor 21 based on image data.

In addition, directly above the tandem image forming section, an endless belt-shaped intermediate transfer belt 1 is disposed as an intermediate transfer body. This intermediate transfer belt 1 is wound around support rollers 1*a*, 1*b*. The support roller 1*a* serving as a driving roller includes a rotary shaft, which is connected to a drive motor as a drive source. When the drive motor is driven, the intermediate transfer belt 1 rotatably moves in the counterclockwise direction in the figure and the support roller 1*b*, which is rotatable driven by the drive motor, rotates. Each of primary transfer units 11Y, 11C, 11M, and 11K is disposed inside the intermediate transfer belt 1 and transfers a toner image formed on each of the photoreceptors 21Y, 21C, 21M, and 21K onto the intermediate transfer belt 1.

A secondary transfer roller 5 is disposed downstream of the primary transfer units 11Y, 11C, 11M, and 11K in the driving direction of the intermediate transfer belt 1. The support roller 1*b* is disposed opposite the secondary transfer roller 5 with the intermediate transfer belt 1 sandwiched therebetween, so as to function as a pressing member. In addition, the printer 100 includes a sheet feed cassette 8 to contain recording media P ("sheet", hereinafter), a sheet feed roller 7, a registration roller pair 6, and the like. A fixing device 4 is configured to fix an image formed on a sheet P. The secondary transfer roller 5 is configured to transfer the toner image onto the sheet P. The fixing device 4 and a sheet discharge roller 3 are then disposed downstream of the secondary transfer roller 5 in a conveyance direction of the sheet P.

Next, how the printer 100 is operated will now be described. Each of the toner-image forming units 101Y, 101C, 101M, and 101K rotates a corresponding photoreceptor 21Y, 21C, 21M, or 21K. With the rotation of the photoreceptors 21Y, 21C, 21M, and 21K, each charger 17Y, 17C, 17M, or 17K uniformly charges a corresponding surface of the photoreceptor 21Y, 21C, 21M, or 21K. Next, the optical writing unit 9 radiates laser writing beams based on the image data onto the photoreceptors 21Y, 21C, 21M, and 21K to form a latent image thereon. Then, toner is adhered by each developer 10Y, 10C, 10M, or 10K so that the latent image is rendered visible and a single-color toner image of yellow, cyan, magenta, and black is formed on each of the photoreceptors 21Y, 21C, 21M, and 21K, respectively. The drive motor drives to rotate the support roller 1*a* to thus drive the support roller 1*b*, the secondary transfer roller 5, and the intermediate transfer belt 1, so that the single-color image is sequentially transferred onto the intermediate transfer belt 1 by each of the primary transfer units 11Y, 11C, 11M, and 11K. With the operation above, a synthesized color image is formed on the intermediate transfer belt 1. Each surface of the photoreceptors 21Y, 21C, 21M, and 21K is then cleaned by the photoreceptor cleaner so that the remaining toner is removed and is ready for a next image forming operation.

In sync with the image formation, a sheet P is conveyed by the sheet feed roller 7 from the sheet feed cassette 8 to the registration roller pair 6, and is stopped once. At a matched timing with the image formation, the sheet P is conveyed between the secondary transfer roller 5 and the intermediate transfer belt 1 and the toner image on the intermediate transfer belt 1 is secondarily transferred onto the sheet P by the secondary transfer roller 5.

The sheet P on which the toner image is transferred from the intermediate transfer belt 1 is conveyed into the fixing device 4, in which the fixing device 4 applies heat and pressure to the sheet so that the transferred image thereon is fixed and the sheet will then be discharged outside the printer body. On the other hand, the intermediate transfer belt 1 after the image transfer is cleaned by an intermediate transfer belt cleaner 12 so that the toner remaining on the intermediate transfer belt 1 is removed, and is ready for a next image formation by the tandem image forming section.

Each toner-image forming unit 101Y, 101C, 101M, and 101K is an integral unit in the form of a process cartridge, and detachably attached to the printer body. Then, each process cartridge is drawable toward a front side of the printer 100 along a guide rail fixed inside the body of the printer 100. When the process cartridge is pushed into the body of the printer 100, each toner-image forming unit 101Y, 101C, 101M, or 101K can be installed at its predetermined position.

Figure 2:
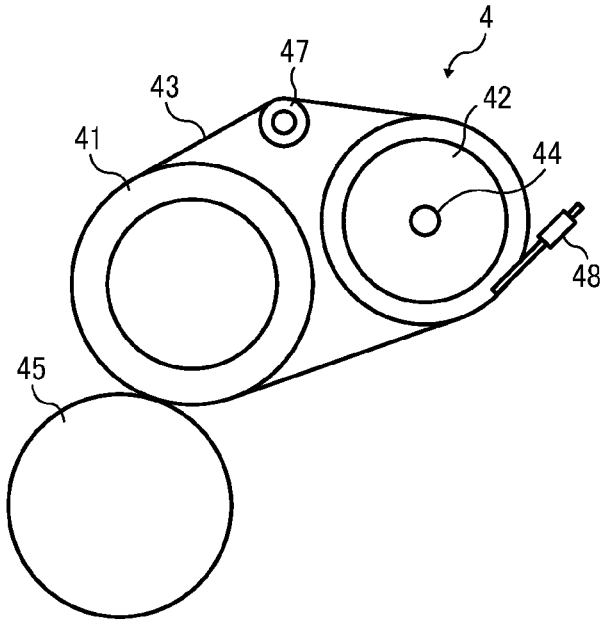
FIG. 2 is a general configuration of a fixing device according to an embodiment of the present invention.

FIG. 2 shows the general configuration of the fixing device 4 in an embodiment of the present invention. The fixing device 4 includes an elastic fixing roller 41 and a pressure roller 45 disposed opposite the fixing roller 41 via a fixing belt 32. A nip is formed where the fixing roller 41 and the pressure roller 45 contact each other. As illustrated in FIG. 2, the fixing device 4 is so configured that the fixing belt 43 is stretched over a heating roller 42 and the fixing roller 41.

The fixing roller 41 includes a metal core and a rubber surface layer formed on the metal core. The rubber layer is sponge-like and made of silicon rubber. The heating roller 42 is a hollow metal roller and includes a built-in heater 44 such as a halogen lamp or an infrared ray radiation lamp and heats the fixing belt 43 from inside the loop formed by the belt. It is to be noted that the heater 44 is not limited to a halogen heater and may be an IH heater. A thermistor 48 serving as a temperature detector is disposed opposite the heating roller 42 via the fixing belt 43. The temperature of the heater 44 is controlled to be a predetermined set temperature based on the detected temperature by the thermistor 48.

The pressure roller 45 is pressed against the fixing roller 41. Further, the pressure roller 45 is driven to rotate by the fixing device driver 402 (see FIG. 4), so that the fixing belt 43 rotates and the fixing roller 41 is driven to rotate accompanied by the rotation of the fixing belt 43. The fixing device 4 further includes a tension roller 47 configured to press against the fixing belt 43 from an inner periphery thereof to bend the fixing belt 43 outwardly by a spring, not shown, so as to apply tension to the fixing belt 43. In the present embodiment, the pressure roller 45 serves as a drive roller. However, alternatively the fixing roller 41 may serve as the drive roller and the pressure roller 45 be configured as a driven roller.

The pressure roller 45 includes a metal core formed of aluminum or iron, and an elastic layer formed of silicon rubber on the metal core. The pressure roller 45 further includes a surface layer or a release layer formed of tetrafluoro-ethylene-perfluoro-alkoxyalkane (PFA) or polytetrafluoroethylene (PTFE).

The fixing belt 43 includes a base material such as nickel and polyimide with a release layer formed of PFA or PTFE. The fixing belt 43 may also include an elastic layer formed of silicon rubber between the base materials and the release layer.

The sheet P enters the nip formed between the fixing roller 41 and the pressure roller 45. The sheet is conveyed to and pressed at the nip with predetermined heat and pressure so that the image on the sheet is fixed and the sheet is further conveyed.

Figure 3A:
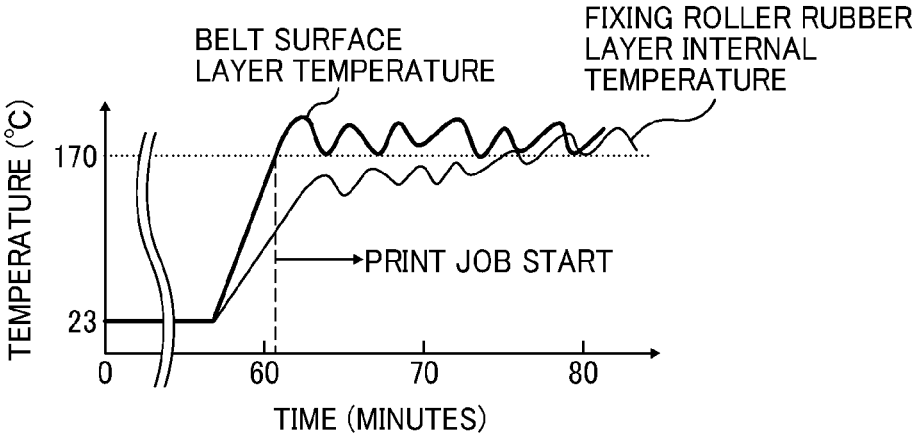
FIGS. 3A and 3B are graphs illustrating a temperature profile of each of a surface of a fixing belt and an inner part of a fixing roller rubber layer.
Figure 3B:
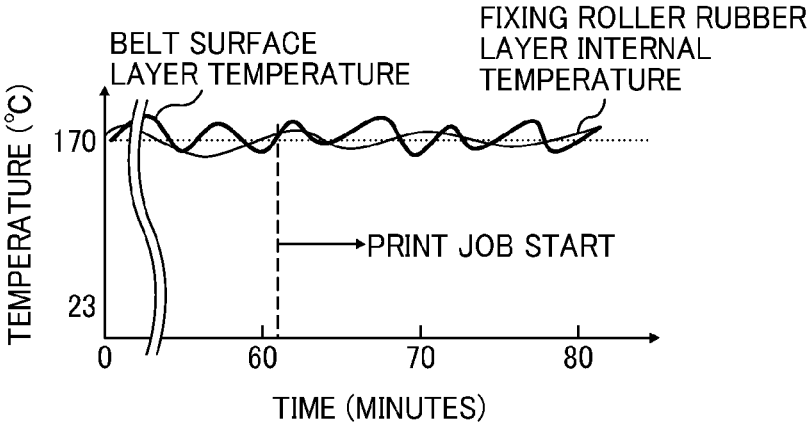

FIGS. 3A and 3B each are a graph illustrating a temperature profile of a surface of the fixing belt 43 of the fixing device 4 and that of an internal part of the rubber layer of the fixing roller 41. FIG. 3A is a graph illustrating the temperature profiles of the belt surface and the internal part of the rubber layer of the fixing roller 41 in a state in which the heater is turned on from an initial rise time and FIG. 3B is a graph illustrating the same in a heat-saturated state.

As illustrated in FIG. 3A, when the heater is turned on from an initial rise time, the surface temperature of the fixing belt 43 rises to a target temperature (i.e., 170° C.) in 10 minutes or so, but the temperature rise of the internal part of the rubber layer of the fixing roller 41 is delayed and 25 minutes more are required so that the internal temperature of the rubber layer of the fixing roller 41 becomes the same temperature as that of the surface temperature of the fixing belt 43.

In the conventional fixing device 4, at a time when the surface temperature of the fixing belt 43 reaches a target temperature (170° C. in the figure) as detected by the thermistor 48, idling time is finished and a print job is started, and the sheet is conveyed into the fixing nip. However, as illustrated in FIG. 3A, when the heater is turned on from an initial rise time, even though the surface temperature of the fixing belt 43 reaches the target temperature (170° C.), the internal temperature of the rubber layer of the fixing roller 41 does not reach the target temperature (170° C.). Therefore, at a time when the surface temperature of the fixing belt 43 reaches the target temperature (170° C.), the fixing roller 41 does not expand with heat to a certain degree. As a result, the nip pressure is lower than a desired pressure and the nip length is shorter than a desired length. Further, when the sheet is conveyed to the fixing nip, the thermal capacity of the fixing belt 43 is absorbed by not only the sheet but also by the fixing roller 41. As a result, because the toner image on the sheet is not supplied with the predetermined amount of heat and pressure, defective fixation occurs.

By contrast, as illustrated in FIG. 3B, when the fixing device 4 is sufficiently heated, the surface temperature of the fixing belt 43 and the rubber layer internal temperature of the fixing roller 41 each have substantially the desired temperatures. In such a case, the fixing roller 41 expands to a predetermined degree and the fixing nip has a predetermined nip pressure and length. Further, not much heat is absorbed by the fixing roller 41 from the fixing belt 43. Accordingly, in a heat-saturated state as illustrated in FIG. 3B, the print job starts when the surface of the fixing belt 43 is heated to a predetermined degree. Then, a predetermined heat amount and pressure can be applied to a toner image on the sheet which is conveyed to the fixing nip, thereby obtaining an optimal image.

Accordingly, in the present embodiment, when a print job signal is received in the initial rise time in which the internal temperature of the rubber layer of the fixing roller 41 does not reach the target temperature even though the fixing belt surface temperature reaches a target temperature, after a warming-up operation in which pre-rotation operation is performed during a predetermined time is performed, the print job starts. By contrast, in a case in which the fixing device 4 is sufficiently heated and the internal temperature of the rubber layer of the fixing roller 41 reaches substantially the target temperature, the print job starts upon receiving the print job signal.

How the printer according to the present embodiment operates will now be described in detail.

Figure 4:
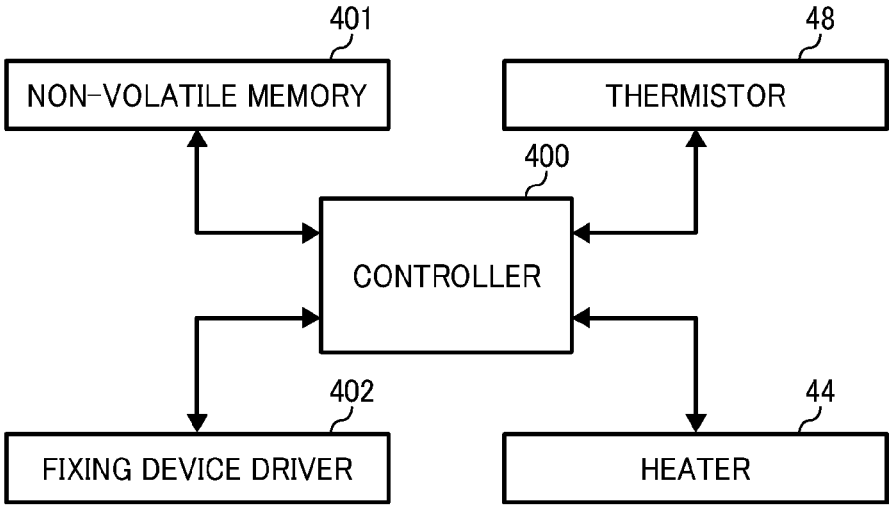
FIG. 4 is a block diagram of the image forming apparatus hardware.

FIG. 4 is a block diagram of the printer 100. A controller 400 serving as a controlling means controls driving of various devices mounted in the printer 100. The controller 400 is connected to various devices, but only the devices related to the controls of the fixing device 4 are particularly shown. The controller 400 is connected to the fixing device driver 402 configured to drive the fixing belt 43, the heater 44, a nonvolatile memory 401, and the thermister 48. The controller 400 turns the heater 44 on and off based on the detection results obtained by the thermistor 48 of the surface temperature of the fixing belt 43. For example, the controller 400 turns the heater 44 off when the surface temperature of the fixing belt 43 as detected by the thermistor 48 becomes a target temperature (for example, 170° C.) plus−$\alpha$° C. ($\alpha$>0). Then, the controller 400 turns the heater 44 on when the surface temperature of the fixing belt 43 as detected by the thermistor 48 becomes a target temperature (for example, 170° C.) minus $\beta$° C. ($\beta \geq 0$). The nonvolatile memory 401 stores operation history of the heater 44.

Figure 5:
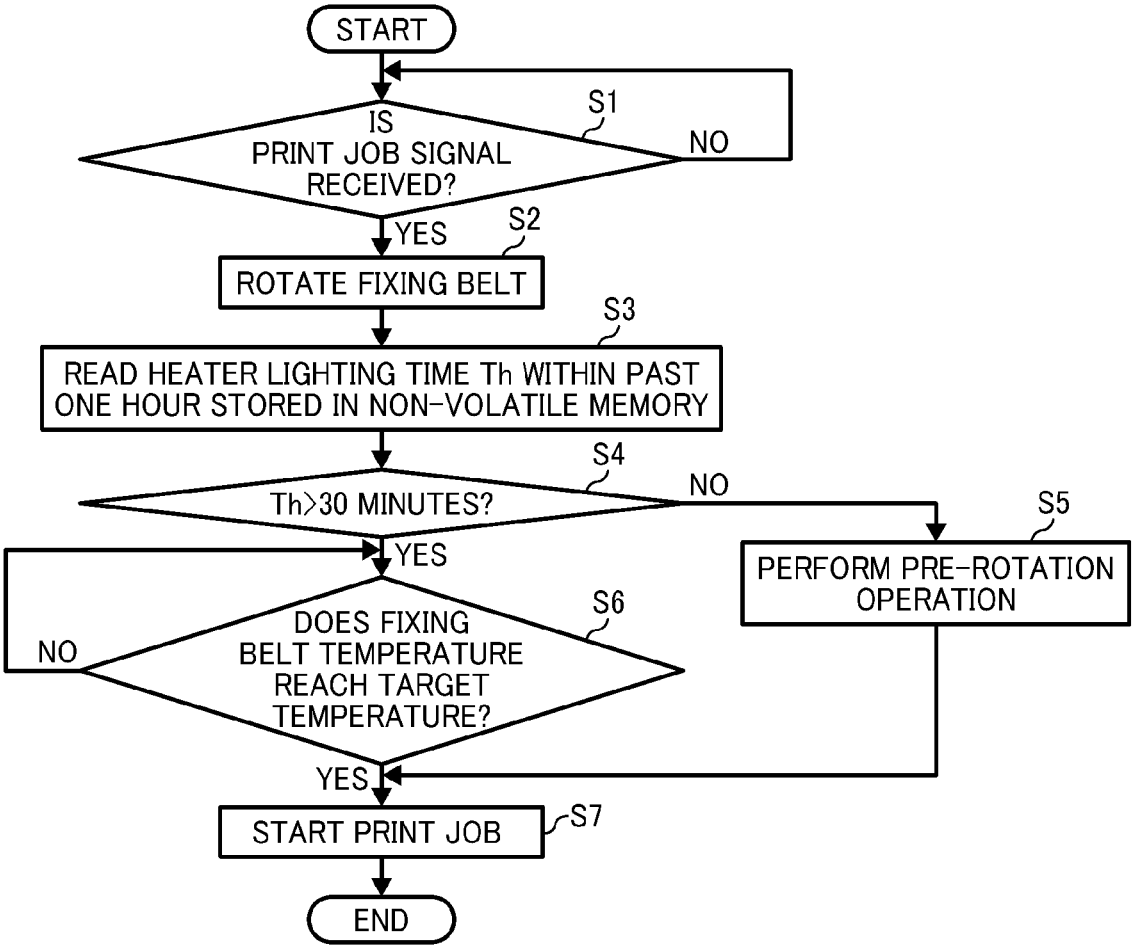
FIG. 5 is a control flowchart embodied in the present invention.

FIG. 5 is a control flowchart of the fixing device 4 according to an embodiment of the present invention.

As illustrated in FIG. 5, when a print job signal is received (Yes in step S1), the controller 400 drives the fixing device driver 402 to rotate the fixing belt 43 (in step S2). Next, heater on-time Th within the past one hour is read from the nonvolatile memory 401 (in step S2). Next, when the heater on-time Th exceeds 30 minutes (Yes in step S4), it is determined that enough heat from the heater 44 is supplied to the fixing roller 41 via the fixing belt 43 and the internal temperature of the rubber layer of the fixing roller 41 reaches the target temperature. In such a case, the fixing roller 41 expands to a predetermined degree and the fixing nip has a predetermined nip pressure and length. In this case, upon the surface temperature of the fixing belt 43 as detected by the thermistor 48 having reached the target temperature (Yes in step S6), the print job is started (in step S7).

On the other hand, when the cumulative on-time Th of the heater 44 is below 30 minutes (No in step S4), it is determined that not enough heat from the heater 44 is supplied to the fixing roller 41 via the fixing belt 43 and the internal temperature of the rubber layer of the fixing roller 41 possibly is below the target temperature. In such a case, a thermal expansion amount of the fixing roller 41 does not reach a predetermined thermal expansion rate and the fixing nip may have a lower nip pressure and a shorter nip length than the desired, predetermined nip pressure and length. In this case, a pre-rotation operation is performed to allow the fixing belt 43 to rotate as a warming-up operation during a predetermined time of period (30-Th min) After the pre-rotation operation has been performed for the predetermined time (30-Th minutes), a print job is performed (in step S7).

Figure 6:
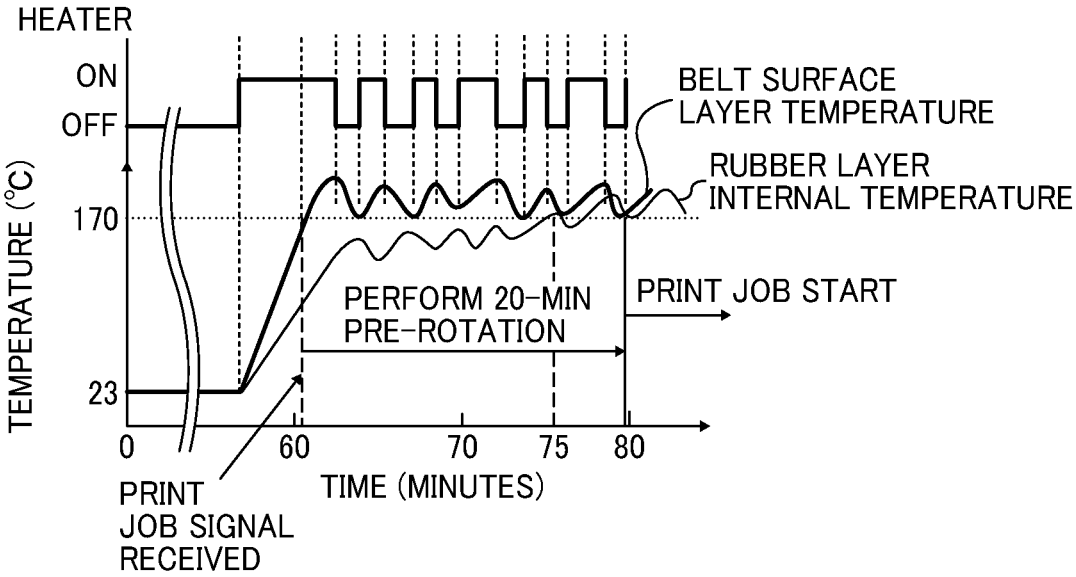
FIG. 6 is a graph illustrating a temperature profile of each of a surface of the fixing belt and an inner part of the fixing roller rubber layer, and a print job start timing from an initial rise time when a control according to the present embodiment is performed.

Specifically, as illustrated in FIG. 6, when a print job signal is received, for example, after 10 minutes have elapsed from the initial rise state, because the heater on-time Th is 10 minutes, the internal temperature of the rubber layer of the fixing roller 41 does not reach the target temperature. Accordingly, the fixing belt 43 is caused to perform the pre-rotation for 20 minutes (30 minutes minus 10 minutes) before starting the print job. As illustrated in FIG. 6, because the internal temperature of the rubber layer of the fixing roller 41 reaches the target temperature in 15 minutes after the print job signal was received, it can be understood from FIG. 6 that 20 minutes of pre-rotation operation is excessive. However, the example as illustrated in FIG. 6 is a case in which the temperature is 23 degrees C., and naturally it takes longer for the internal temperature of the rubber layer of the fixing roller 41 to reach the target temperature in a low-temperature environment compared to a case as illustrated in FIG. 6. Specifically, the time for the pre-rotation according to the present embodiment is set to a time of period such that the internal temperature of the rubber layer of the fixing roller 41 reaches the target temperature even in a low-temperature environment. Alternatively, the time for the pre-rotation can be determined based on the ambient temperature of the fixing device 4 and the cumulative on-time Th of the heater 44. For example, the set time may be 30-Th (min) for the low-temperature environment and may be 20-Th (min) for the normal temperature environment.

As illustrated in FIG. 6, the heater 44 continues to be turned on (i.e., lighting state) during 10 minutes until the surface temperature of the fixing belt 43 reaches the target temperature from the initial rise time, but the heater 44 is controlled to alternately switch between an ON state and an OFF state after the surface temperature of the fixing belt 43 reaches 170° C. An cumulative heater on-time until the internal temperature of the rubber layer of the fixing roller 41 reaches the target temperature after the initial rise time amounts to about 17.5 minutes by calculation of 10+(15/2). Therefore, the heater on-time Th of 20 minutes within the past one hour is sufficient to increase the internal temperature of the rubber layer of the fixing roller 41 up to the target temperature. However, because the example as illustrated in FIG. 6 is a case of the normal temperature of 23 degrees, more thermal capacity is required so that the internal temperature of the rubber layer of the fixing roller 41 reaches the target temperature compared to a case of FIG. 6. Specifically, the threshold of the cumulative on-time of the heater 44 according to the present embodiment is set to a heating time necessary for the internal temperature of the rubber layer of the fixing roller 44 to reach the target temperature even in a low-temperature environment. Of course, the threshold for the pre-rotation can be changed based on the ambient temperature of the fixing device 4.

Figure 7:
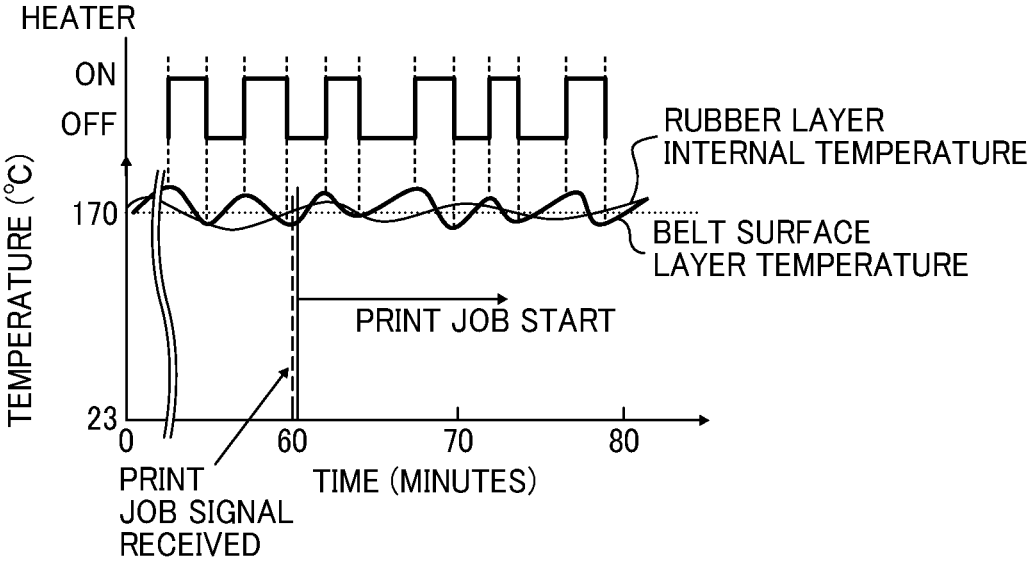
FIG. 7 is a graph illustrating a temperature profile of each of a surface of the fixing belt and an inner part of the fixing roller rubber layer and a print job start timing when heating is in a heat-saturated state when a control according to the present embodiment is performed.

In addition, as illustrated in FIG. 7, in a heat-saturated state in which the fixing device 4 is sufficiently heated, the heater 44 is controlled to be turned off for a predetermined time after having been turned on for a predetermined time. Because normally the cumulative time of turned-on state per one hour is longer than that of turned-off state, the cumulative on-time of the heater 44 exceeds 30 minutes. Accordingly, in the heat-saturated state in which the fixing device 4 is sufficiently heated, a print job is started without performing the pre -rotation operation.

Thus, by using as a proxy the cumulative heating time of the heater 44, the thermal capacity applied to the rubber layer of the fixing roller 41 can be ascertained via the fixing belt 43, and the internal temperature of the rubber layer of the fixing roller 41 can be forecasted. When the heating time is short and the rubber layer of the fixing roller 41 is not uniformly heated, the pre-rotation operation is performed, so that the sheet is conveyed to the fixing nip in a state in which the internal temperature of the rubber layer of the fixing roller 41 reaches a target temperature uniformly. This structure ensures improved thermal expansion of the fixing roller 41 during printing operation and prevent defective fixation of the printed image.

If the operation history of the heater 44 is stored in a volatile memory and the power is turned off abruptly, the operation history thereof is erased even if power is restored immediately. As a result, even though the heater on-time Th of the heater 44 exceeds 30 min. within the past one hour and the internal temperature of the rubber layer of the fixing roller 41 has already reached the target temperature, there is a case in which a pre-rotation operation is still performed. This is because, due to the lack of the operation history in the memory, the heater on-time Th is determined to be below 30 min. within the past one hour in the printing job after the power is resumed.

However, in the present embodiment, because the operation history of the heater 44 is stored in the nonvolatile memory 401, the heater on-time before any abrupt loss of power can be added to the cumulative on-time in the print job after power is restored, thus preventing unnecessary pre-rotation regardless of the internal temperature of the rubber layer that has already reached the target temperature.

In the above embodiment, the determination on whether the pre-rotation operation is to be performed or not is made based on the heater on-time Th within the past one hour that is selected as an operation history of the heater 44. However, the determination need not be based on only the above.

[First Modification]

Figure 8:
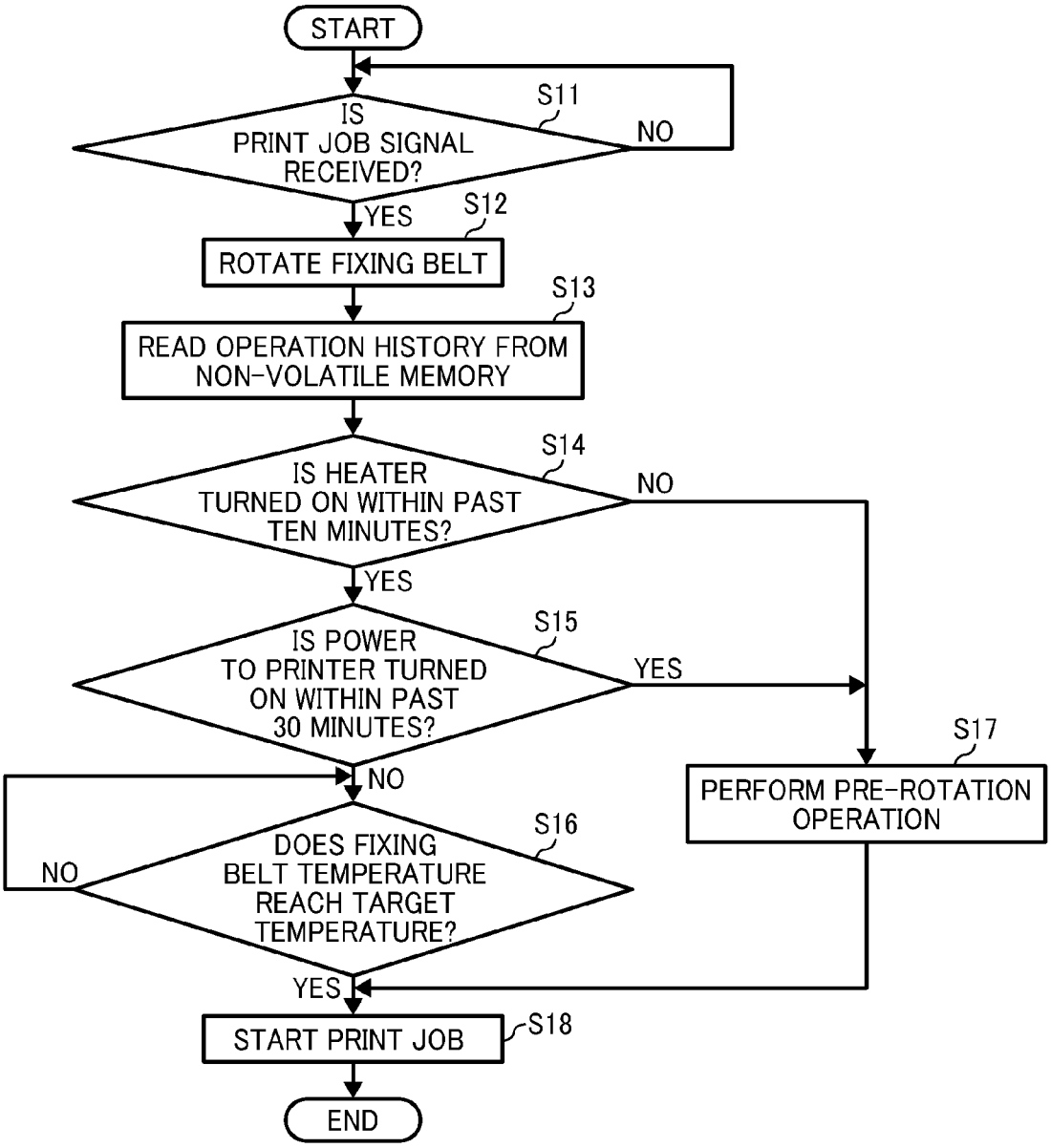
FIG. 8 is a control flowchart embodied in a modification 1.

FIG. 8 is a flowchart illustrating a control flow of a first modification. The first modification is a case in which the pre-rotation is not performed when 30 minutes or more have passed after the power to the printer is turned on and there is a history to show that the heater 44 is lit within the past 10 minutes.

As illustrated in FIG. 8, when a print job signal is received (Yes in step S11), the controller 400 drives the fixing device driver 402 to rotate the fixing belt 43 (in step S12). The operation history is read from the nonvolatile memory 401 (in step S13) and whether there is a operating history of the heater 44 within the past ten minutes or not is checked (in step S14). When there is no heater operating history within the past 10 minutes (No in step S14), there is a possibility that the internal temperature of the rubber layer of the fixing roller 41 is below the target temperature, and therefore a 15-minute pre-rotation operation is performed (in step S17). In addition, as illustrated in FIG. 3A, even though there is a operating history of the heater 44 within the past 10 minutes, there is a case in which, when the heater is turned on from an initial rise time, the internal temperature of the rubber layer of the fixing roller 41 does not reach the target temperature. Accordingly, even though there is a heater operating history within the past 10 minutes (Yes in step S14), when there is an operation history indicating that the fixing device has been turned on within the past 30 minutes (Yes in step S15), a 15-minute pre-operation is performed (in step S17) because there is a possibility that the internal temperature of the rubber layer of the fixing roller 41 is below the target temperature. Thereafter, the print job is started (in step S18).

By contrast, a state in which there is a operating history of the heater 44 within the past 10 minutes (Yes in step S14) and there is no history that the printer is turned on within the past 30 minutes (No in step S15) shows the heat-saturated state as illustrated in FIG. 3B. In this state, it is determined that the internal temperate of the rubber layer of the fixing roller 41 has reached the target temperature. In this case, upon the surface temperature of the fixing belt 43 as detected by the thermistor 48 having reached the target temperature (Yes in step S16), the printing job is started (in step S18).

The first modification also ensures improved thermal expansion of the fixing roller 41 during printing operation and prevent defective fixation of the printed image. Further, because the time when the heater is turned on and the time when the power to the printer is turned on may be stored in the nonvolatile memory 401, the memory capacity of the nonvolatile memory 401 can be saved compared to a case in which the operating history of the heater 44 within the past one hour to the current time is stored.

[Second Modification]

Figure 9:
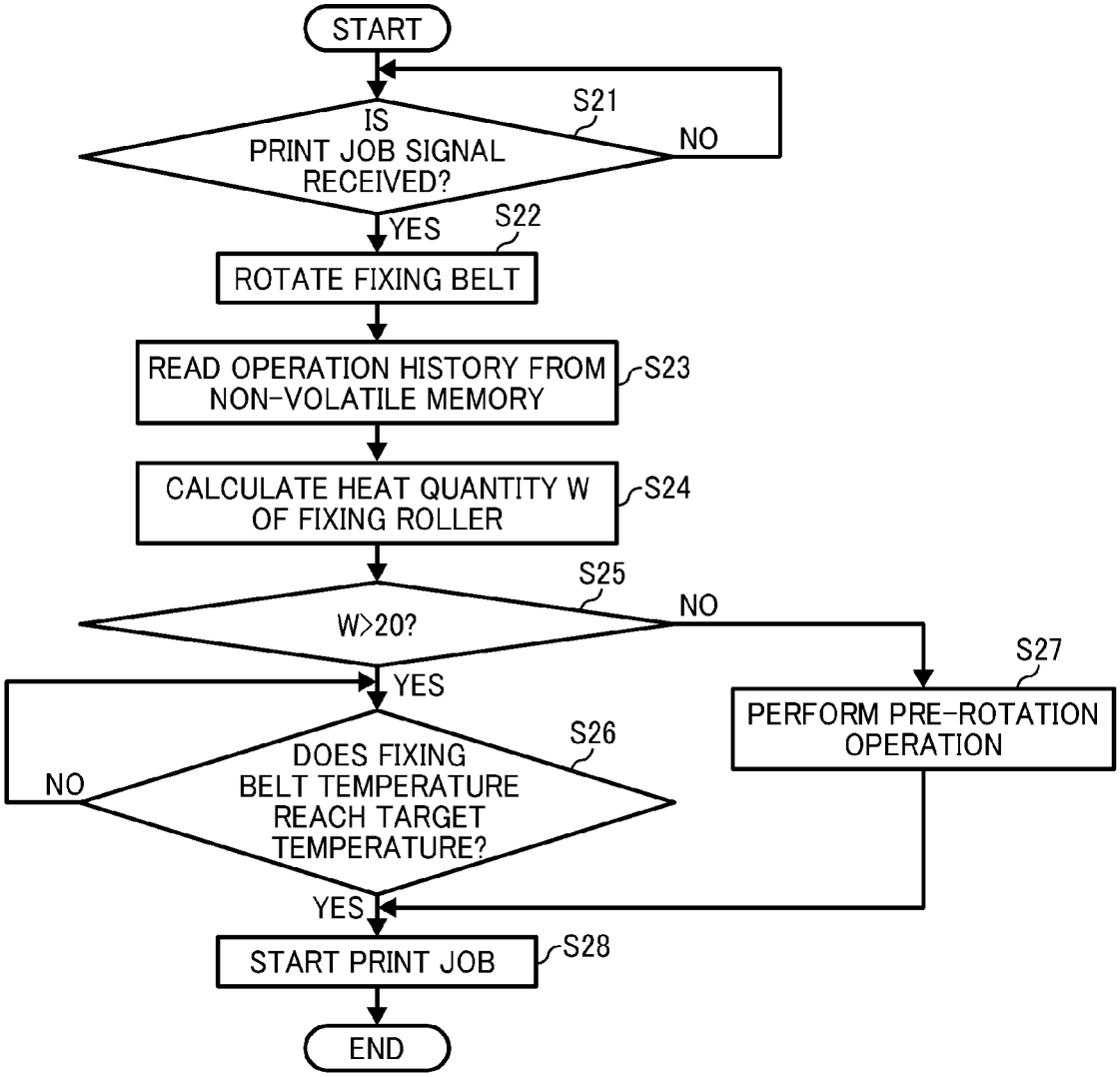
FIG. 9 is a control flowchart embodied in a modification 2.

FIG. 9 is a flowchart illustrating a control flow of a second modification. In the second modification, the thermal capacity of the fixing roller 41 is obtained by calculation based on the thermal capacity of the heater 44 and the heat loss, not transmitted to the fixing roller 41, such as the heat absorbed by the sheet and the heat thermally conducted to a housing of the fixing device. From the calculated thermal capacity, whether the pre-rotation operation should be performed or not is determined.

As illustrated in FIG. 9, when a print job signal is received (Yes in step S21), the controller 400 drives the fixing device driver 402 to rotate the fixing belt 43 (in step S22). The operation history is read from the nonvolatile memory 401 (in step S23) and the thermal capacity W of the fixing roller 41 is calculated based on the operation history thereof (in step S24).

Figure 10:
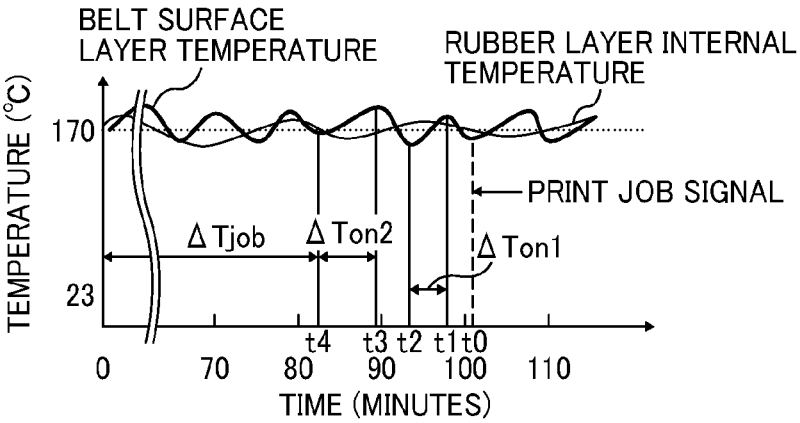
FIG. 10 is an example of a temperature profile when thermal capacity of the fixing roller is calculated.

The nonvolatile memory 401 stores the operation history of the heater 44 from a time at which the heater 44 receives a print job signal and within the past 100 minutes including (a) operation time period ΔTjob of the heater 44 during printing operation; and (b) operation time period ΔTon of the heater 44 not performing any printing operation. The thermal capacity W of the fixing roller 41 upon receiving the print job signal is obtained by time integration of the following formula 1:

$$W=0.5*\Delta T\text{job}*\exp(-t/100)+\Delta T\text{on}*\exp(-t/100) \quad (1)$$

wherein "t" is a retrospective time from a point in time when the print job signal is received set at 0 (zero). In addition, 0.5 is an absorption coefficient simulating the quantity of heat absorbed by the recording sheet and exp is a modeling of heat dissipation. For example, in a case of a temperature profile as illustrated in FIG. 10, W is calculated as follows:

$$W=\int 0.5*\Delta T\text{job}*\exp(-t/100)dt+\int \Delta T\text{on1}*\exp(-t/100)dt+\int \Delta T\text{on2}*\exp(-t/100)dt,$$

wherein integral interval of ΔTjob is t4 to t100, t1 to t2 for ΔTon1, and t3 to t4 for ΔTon2.

When the calculated thermal capacity W exceeds 20 (Yes in step S25), it is determined that the fixing roller 41 is sufficiently heated up to the internal portion and the pre-rotation is not performed. Upon the surface temperature of the fixing belt 43 having reached the target temperature (Yes in S26), the printing job is started (in step S28).

On the other hand, when the calculated thermal capacity W is below 20 (No in step S25), it is determined that the fixing roller 41 may not be sufficiently heated up to the internal portion and 15-minute pre-rotation is performed (in step S27). Thereafter, the printing job is started (in step S28). The duration of time for the pre-rotation operation may be arbitrarily determined based on the calculated thermal capacity W.

The second modification also ensures improved thermal expansion of the fixing roller 41 during printing operation and prevent defective fixation of the printed image. Further, by calculating a heat balance to and from the actual fixing roller 41, the thermally expanded status of the fixing roller 41 can be accurately estimated upon receiving the print job signal.

[Third Modification]

Figure 11:
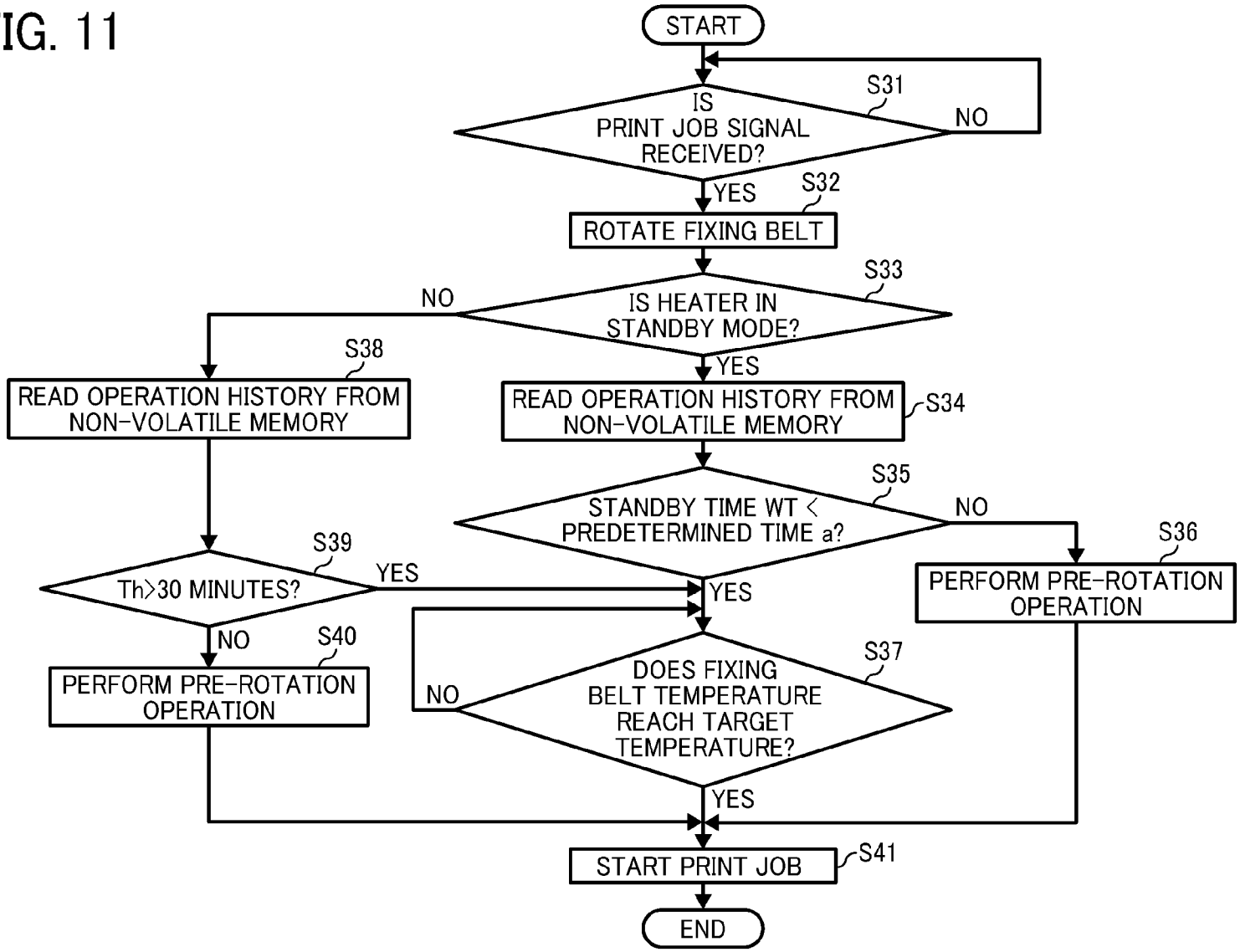
FIG. 11 is a control flowchart embodied in a modification 3.

FIG. 11 is a flowchart illustrating a control flowchart of a third modification.

Figure 12:
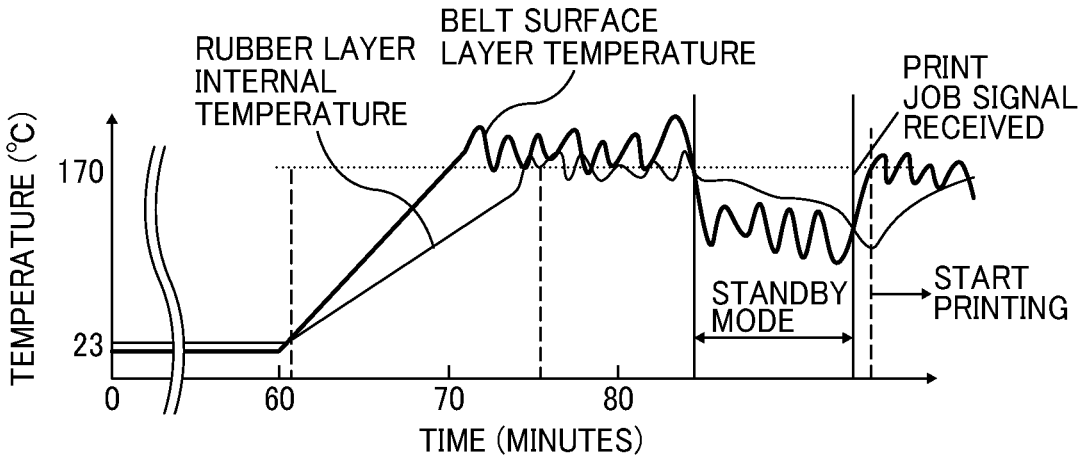
FIG. 12 is an example of a temperature profile when a predetermined time elapses in a standby mode.
Figure 13:
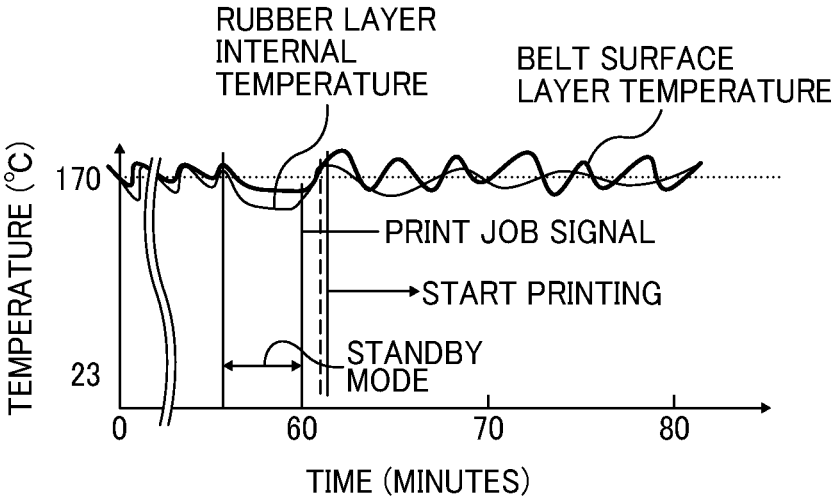
FIG. 13 is an example of a temperature profile when the standby mode continues for less than a predetermined time.

Certain printers are controlled so that the power to be applied to the heater 44 is turned off and the heater 44 enters a standby mode for energy-saving purposes when the print job is not performed. If the standby mode time WT is long, the internal temperature of the fixing roller 41 decreases. As a result, as illustrated in FIG. 12, when the power to be applied to the heater is resumed and the printer returns to a normal operating state upon receiving the print job signal, even though the surface temperature of the fixing belt 43 rises to the target temperature soon, the internal temperature of the rubber layer of the fixing roller 41 does not reach the target temperature. By contrast, if the standby time is short as illustrated in FIG. 13, when the fixing belt 43 becomes the target temperature, the rubber layer internal temperature of the fixing roller 41 also reaches a desired temperature. Accordingly, in the third modification, when the print job signal is received in the standby mode, whether the pre-rotation operation is to be performed or not is determined based on the length of time WT of the standby mode.

As illustrated in FIG. 11, when the print job signal is received (Yes in step S31), if the fixing device is in the standby mode (in step S33), the standby mode time WT stored in the nonvolatile memory 401 as an operation history is read. If the standby time WT is below a predetermined time "a" (Yes in step S35), because the rubber layer internal temperature of the fixing roller 41 also reaches a desired temperature when the fixing belt 43 reaches the target temperature as illustrated in FIG. 13, the pre-rotation operation is not performed and the print job is started (in step S41).

By contrast, if the standby time WT exceeds a predetermined value "a" (No in step S35), because the rubber layer internal temperature of the fixing roller 41 decreases as illustrated in FIG. 12 and may not reach the desired temperature even when the surface temperature of the fixing belt 43 reaches the target temperature. Accordingly, in such a case, 15-minute pre-rotation operation is performed (in step S36), and after the internal temperature of the rubber layer of the fixing roller 41 reaches the target temperature, the print job is started (in step S41).

If the fixing device is not in the standby mode (No in step S33), whether the pre-rotation operation is to be performed or not is determined based on the heater on-time Th within the past one hour, similarly to the control flow as illustrated in FIG. 5.

According to the present invention, when the heater is turned on, a predetermined amount of heat is supplied to a rotary member disposed on a reverse side of the nip portion. When the heater is turned off, because a predetermined amount of heat is discharged from the reverse side of the nip portion, the temperature of the rotary member disposed at the reverse side of the nip can be obtained from the operation history of the heater. Accordingly, by controlling the fixing device to perform the warming-up operation based on the operation history of the heater, the fixing process can be performed when the rotary member at the reverse side of the nip reaches a predetermined temperature. Specifically, the fixing device is controlled to perform the warming-up operation when the heat supplied to the nip reverse-side rotary member is not sufficient and the temperature of the rotary member does not reach a target temperature. With such control, when the toner image on the recording sheet is to be fixed, the heat of the belt member is not absorbed by the rotary member. Further, because the toner image on the recording sheet can be fixed in a condition in which the rotary member is thermally expanded to a certain degree, the toner image fixation can be performed with both predetermined nip pressure and length. With this structure, the toner image on the recording sheet can be optimally fixed because the toner image on the recording sheet is subjected to target heat and pressure.

Additional modifications and variations of the present invention are possible in light of the above teachings. It is therefore to be understood that, within the scope of the appended claims, the invention may be practiced other than as specifically described herein.

What is claimed is:

1. A fixing device to perform a fixing process involving sandwiching a recording sheet in a fixing nip; heating with pressure the recording sheet in the fixing nip; and fixing a toner image onto the recording sheet, the fixing device comprising:

an endless, rotatable belt member;

a nip-forming rotary member disposed outside a loop of the belt member and contacting an external surface of the belt member to form a fixing nip;

a fixing roller disposed at a backside of the fixing nip inside the loop of the belt member and around which the belt member is rotatably stretched;

a heater to heat the belt member at a position different from a position where the belt member is rotatably stretched around the fixing roller;

a temperature detector disposed opposite the belt member;

a memory device to store an operational history of the heater; and a processor operatively connected to the heater to control the heater, before the recording sheet is passed through the fixing nip, to perform a warming-up operation to raise a temperature of the fixing roller at the backside of the fixing nip based on the operational history of the heater stored in the memory device, wherein the memory device stores a cumulative time of heating retroactively from a current time and the processor controls the heater to perform the warming-up operation when the cumulative time of heating is below a threshold value.

2. The fixing device as claimed in claim 1, wherein the memory device is a nonvolatile memory device.

3. The fixing device as claimed in claim 1, wherein the heater is an infrared heater.

4. The fixing device as claimed in claim 1, wherein the heater is a halogen heater.

5. The fixing device as claimed in claim 1, wherein the heater is an IH heater.

6. The fixing device as claimed in claim 1, wherein the temperature detector is a thermistor.

7. An image forming apparatus comprising:

a toner image forming unit to create a toner image on a recording sheet; and the fixing device as claimed in claim 1.

8. A fixing device to perform a fixing process involving sandwiching a recording sheet in a fixing nip; heating with pressure the recording sheet in the fixing nip; and fixing a toner image onto the recording sheet, the fixing device comprising:

an endless, rotatable belt member;

a nip-forming rotary member disposed outside a loop of the belt member and contacting an external surface of the belt member to form a fixing nip;

a fixing roller disposed at a backside of the fixing nip inside the loop of the belt member and around which the belt member is rotatably stretched;

a heater to heat the belt member at a position different from a position where the belt member is rotatably stretched around the fixing roller;

a temperature detector disposed opposite the belt member;

a memory device to store an operational history of the heater; and a processor operatively connected to the heater to control the heater, before the recording sheet is passed through the fixing nip, to perform a warming-up operation to raise a temperature of the fixing roller at the backside of the fixing nip based on the operational history of the heater stored in the memory device, wherein:

the memory stores as an operational history of the heater a latest time when the heater was operated and a time when the fixing device was turned on;

the processor checks if the heater was in operation during a set time period retroactive from the current time based on the latest time when the heater was operated and checks if the fixing device was turned on during a set time period retroactive from the current time based on the time when the fixing device was turned on; and the processor controls the heater to perform the warming-up operation when either the heater was not in operation during the set time period retroactive from the current time or when the fixing device was turned on during the set time period retroactive from the current time.

9. A fixing device to perform a fixing process involving sandwiching a recording sheet in a fixing nip; heating with pressure the recording sheet in the fixing nip; and fixing a toner image onto the recording sheet, the fixing device comprising:

an endless, rotatable belt member:

a nip-forming rotary member disposed outside a loop of the belt member and contacting an external surface of the belt member to form a fixing nip;

a fixing roller disposed at a backside of the fixing nip inside the loop of the belt member and around which the belt member is rotatably stretched;

a heater to heat the belt member at a position different from a position where the belt member is rotatably stretched around the fixing roller;

a temperature detector disposed opposite the belt member;

a memory device to store an operational history of the heater; and a processor operatively connected to the heater to control the heater, before the recording sheet is passed through the fixing nip, to perform a warming-up operation to raise a temperature of the fixing roller at the backside of the fixing nip based on the operational history of the heater stored in the memory device, wherein:

the memory stores, as the operational history of the heater during the set time period retroactive from the current time, an operating time period of the heater when the recording sheet is passed through the fixing nip and an operating time period of the heater when the recording sheet is not passed through the fixing nip; and the processor calculates the thermal capacity of the fixing roller at the backside of the fixing nip based on the operating time period of the heater when the recording sheet is passed through the fixing nip and the operating time period of the heater when the recording sheet is not passed through the fixing nip during the set time period retroactive from the current time, and controls the heater to perform the warming-up operation when the calculated thermal capacity is below a set threshold value.

* * * * *